US008425139B2

(12) United States Patent
Chan

(10) Patent No.: US 8,425,139 B2
(45) Date of Patent: Apr. 23, 2013

(54) SHEET HOLDER AND EDGE PATTERN MAKING APPARATUS INCORPORATING THE SAME

(76) Inventor: Stephen Kwok Ki Chan, Kowloon Tong (HK)

( * ) Notice: Subject to any disclaimer, the term of this patent is extended or adjusted under 35 U.S.C. 154(b) by 775 days.

(21) Appl. No.: 12/610,559

(22) Filed: Nov. 2, 2009

(65) Prior Publication Data

US 2011/0103881 A1 May 5, 2011

(51) Int. Cl.

| | |
|---|---|
| ***B42F 13/36*** | (2006.01) |
| ***B42F 1/00*** | (2006.01) |
| ***A44B 1/04*** | (2006.01) |
| ***A44B 11/25*** | (2006.01) |
| ***A44B 17/00*** | (2006.01) |
| ***B26D 7/02*** | (2006.01) |
| ***B26D 5/08*** | (2006.01) |

(52) U.S. Cl.
USPC ..... 402/68; 402/69; 24/67.3; 24/67.5; 24/67.7; 83/453; 83/560

(58) Field of Classification Search ..... 402/1, 66, 402/68–69; 281/44–45; 24/67 R, 67.3, 67.5, 24/67.7; 83/453, 560, 618, 619, 633
See application file for complete search history.

(56) References Cited

U.S. PATENT DOCUMENTS

| | | | | |
|---|---|---|---|---|
| 2,638,986 | A * | 5/1953 | Emmer | 83/633 |
| 3,423,798 | A * | 1/1969 | O'Donnell | 24/67.7 |
| 3,492,701 | A * | 2/1970 | Kitamura | 24/67.7 |
| 3,752,504 | A * | 8/1973 | Dixon | 402/69 |
| 4,509,397 | A * | 4/1985 | Mori et al. | 83/453 |
| 4,594,927 | A * | 6/1986 | Mori | 83/633 |
| 5,570,907 | A * | 11/1996 | Dromi et al. | 281/45 |
| 5,683,218 | A * | 11/1997 | Mori | 412/69 |
| 6,739,783 | B2 * | 5/2004 | Higashino et al. | 402/69 |
| 7,874,758 | B2 * | 1/2011 | Tanaka et al. | 402/69 |

* cited by examiner

*Primary Examiner* — Dana Ross
*Assistant Examiner* — Kyle Grabowski
(74) *Attorney, Agent, or Firm* — Leydig, Voit & Mayer, Ltd.

(57) ABSTRACT

A sheet holder for holding a sheet of paper and exposing an edge of the sheet, has a press for holding the paper sheet and exposing the edge, and a lever for operating the press. The lever is movable between a released position for placing of the edge of the paper sheet in the press and a holding position for operating the press. There is also an abutment for abutment by the edge of the paper sheet to position the edge relative to the press while the lever is in the released position. The abutment is associated with the lever for moving away from the edge of the paper sheet when the lever moves towards the holding position, thereby exposing the edge of the paper sheet.

7 Claims, 8 Drawing Sheets

SHEET HOLDER AND EDGE PATTERN MAKING APPARATUS INCORPORATING THE SAME

The present invention relates to a sheet holder and to an edge pattern making apparatus incorporating the same for making a pattern along an edge of a sheet of material.

BACKGROUND OF THE INVENTION

Edge or border punches come in different styles and are used to create a beautiful die-cut border design for cards and other paper crafts. Some of the punches are designed to emboss and cut simultaneously or separately.

Guides printed on the tool are used for alignment so that a neat continuous pattern along the edge can be obtained, but good alignment is not always guaranteed. To ensure perfect alignment a physical guide is available in some models, which is an independent piece and must be removed or detached each time after use before the punch can be deployed.

The invention seeks to mitigate or at least alleviate such a problem by providing a new or otherwise improved sheet holder and to an edge pattern making apparatus incorporating the same.

SUMMARY OF THE INVENTION

According to a first aspect of the invention, there is provided a sheet holder for holding a sheet of material and exposing an edge thereof, comprising:

a holding mechanism for holding a said sheet of material and exposing an edge thereof;

an operator for operating the holding mechanism, the operator being movable between a released position for placing of the edge of the sheet in the holding mechanism and a holding position for subsequently operating the holding mechanism; and an abutment for abutment by the edge of the sheet to position the edge relative to the holding mechanism while the operator is in the released position, the abutment being associated with the operator for moving away from the edge of the sheet at the same time as the operator moves towards the holding position, thereby exposing the edge of the sheet.

Preferably, the abutment is connected with the operator for simultaneous movement.

More preferably, the abutment is an integral part of the operator.

In a preferred embodiment, the operator is supported above the holding mechanism for pivotal movement between the released position and the holding position on opposite sides of the holding mechanism.

It is further preferred that the operator has an edge portion acting as the abutment which in the released position of the operator extends downwards for abutment by the edge of the sheet.

It is yet further preferred that the edge portion is a flange of the operator.

It is advantageous that the holding mechanism comprises a press that includes a rubber member to provide a rubber grip.

In a preferred embodiment, the sheet holder includes a wall along which the exposed edge of the sheet is to be positioned, and a series of locating formations at regular intervals along the wall for locating an edge pattern maker successively along the wall for repeated operations upon and along the exposed edge.

According to a second aspect of the invention, there is provided an edge pattern making apparatus for making a pattern along an edge of a sheet of material, comprising:

a sheet holder having a holding mechanism for holding a said sheet of material and exposing an edge thereof, and an operator for operating the holding mechanism, the operator being movable between a released position for placing of the edge of the sheet in the holding mechanism and a holding position for subsequently operating the holding mechanism, the sheet holder having a wall along the exposed edge of the sheet and a series of locating formations at regular intervals along the wall; and an edge pattern maker for making a series of patterns along the exposed edge of the sheet through repeated operations each for one pattern, the edge pattern maker having a part for alignment with the locating formations to locate the edge pattern maker successively along the wall of the sheet holder for the repeated operations;

wherein the sheet holder includes an abutment for abutment by the edge of the sheet to position the edge relative to the holding mechanism while the operator is in the released position, the abutment being associated with the operator for moving away from the edge of the sheet at the same time as the operator moves towards the holding position, thereby exposing the edge of the sheet.

Preferably, the abutment is connected with the operator for simultaneous movement.

More preferably, the abutment is an integral part of the operator.

In a preferred embodiment, the operator is supported above the holding mechanism for pivotal movement between the released position and the holding position on opposite sides of the holding mechanism.

It is further preferred that the operator has an edge portion acting as the abutment which in the released position of the operator extends downwards for abutment by the edge of the sheet.

It is yet further preferred that the edge portion is a flange of the operator.

It is an advantage that the holding mechanism comprises a press that includes a rubber member to provide a rubber grip.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
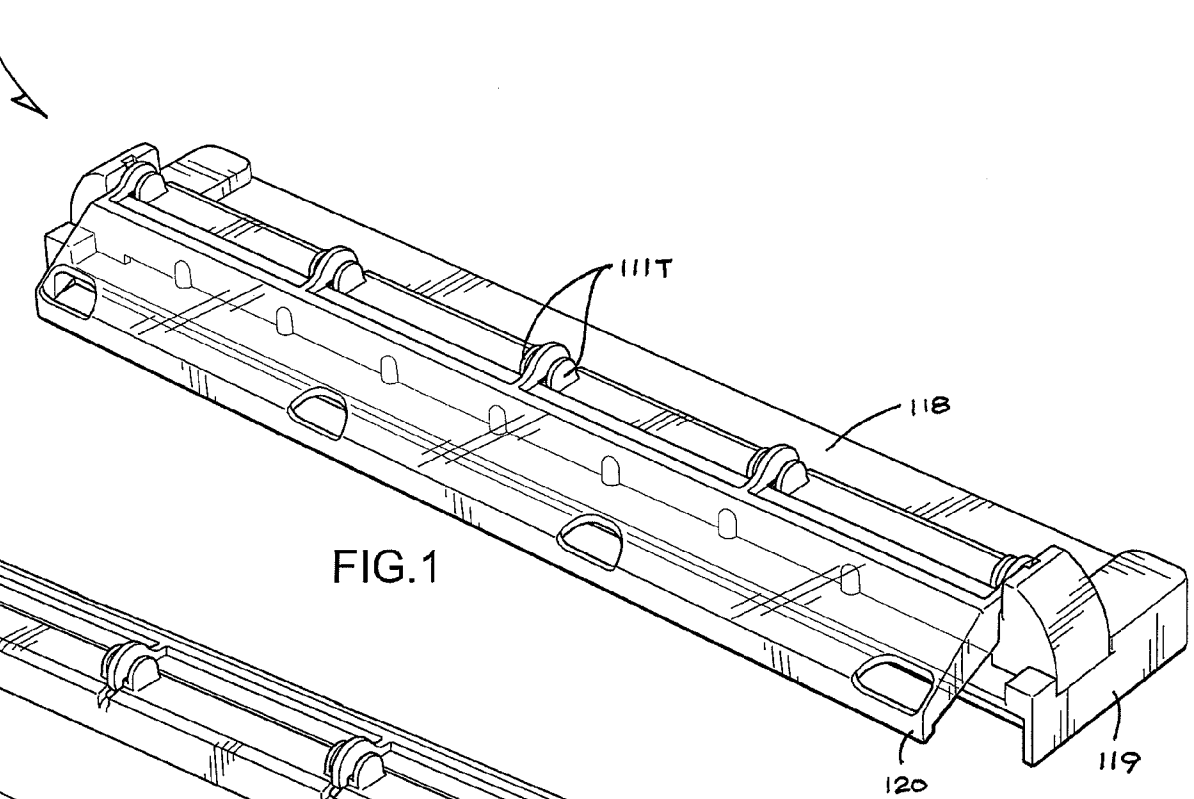
FIG. 1 is a perspective view of an embodiment of a sheet holder in accordance with the invention.
Figure 2:
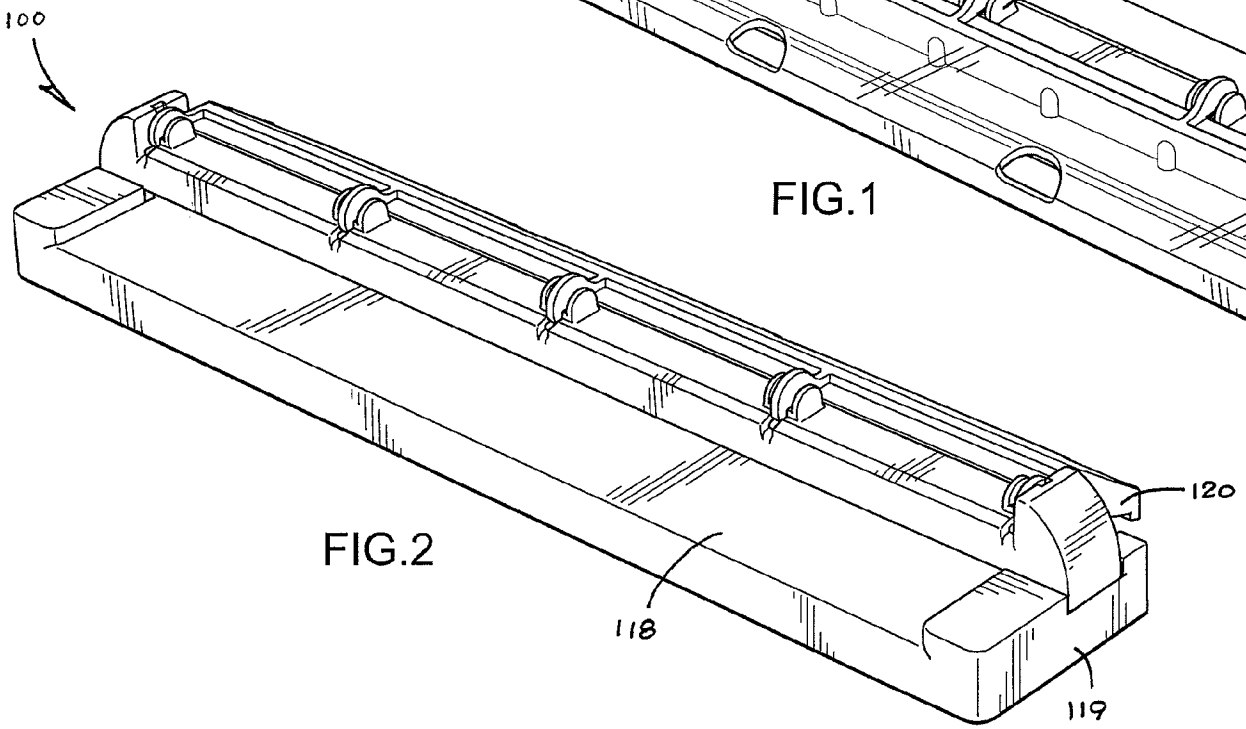
FIG. 2 is another perspective view, taken from the opposite direction, of the sheet holder of FIG. 1.
Figure 3:
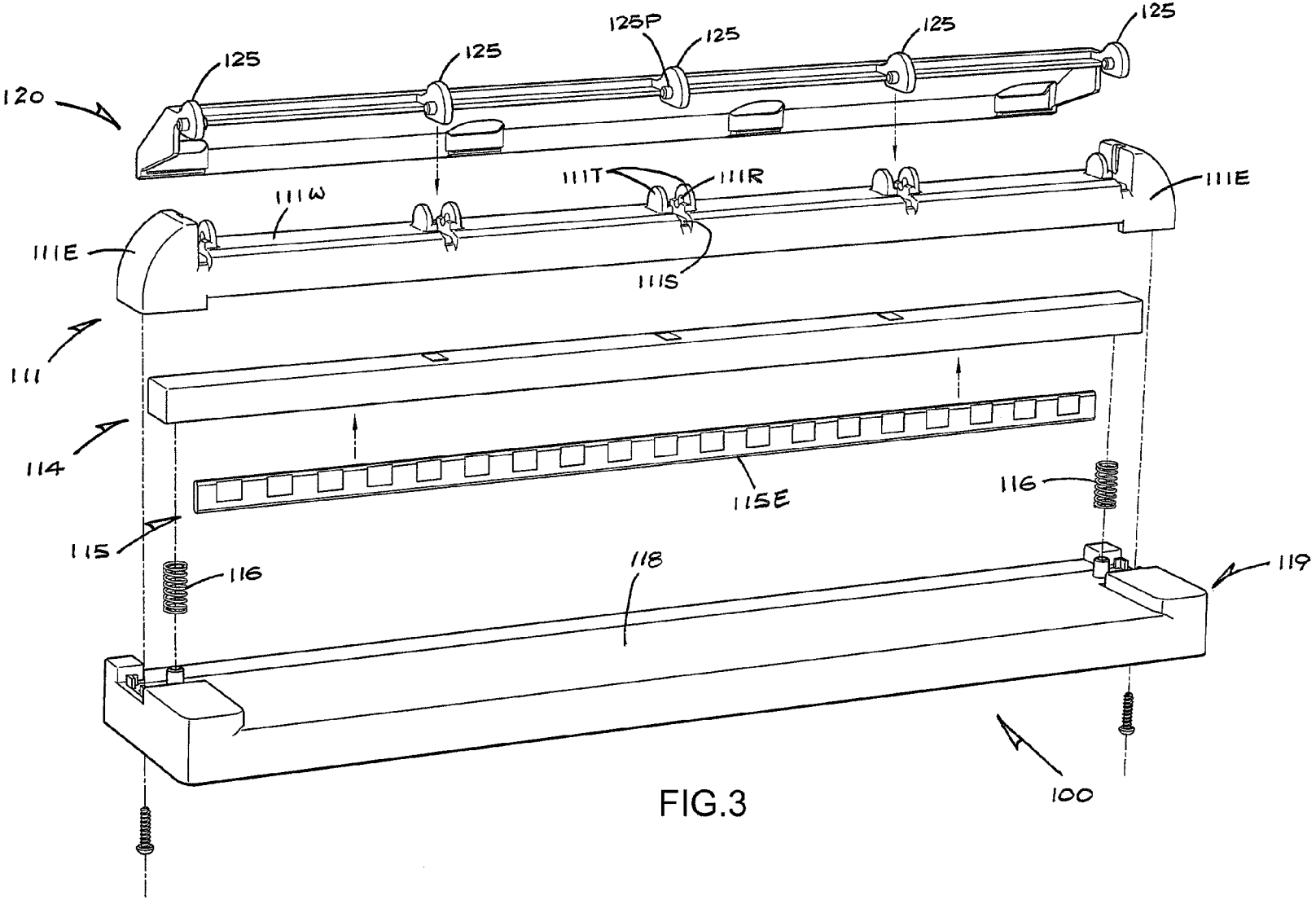
FIG. 3 is an exploded perspective view of the sheet holder of FIG. 1.
Figure 4:
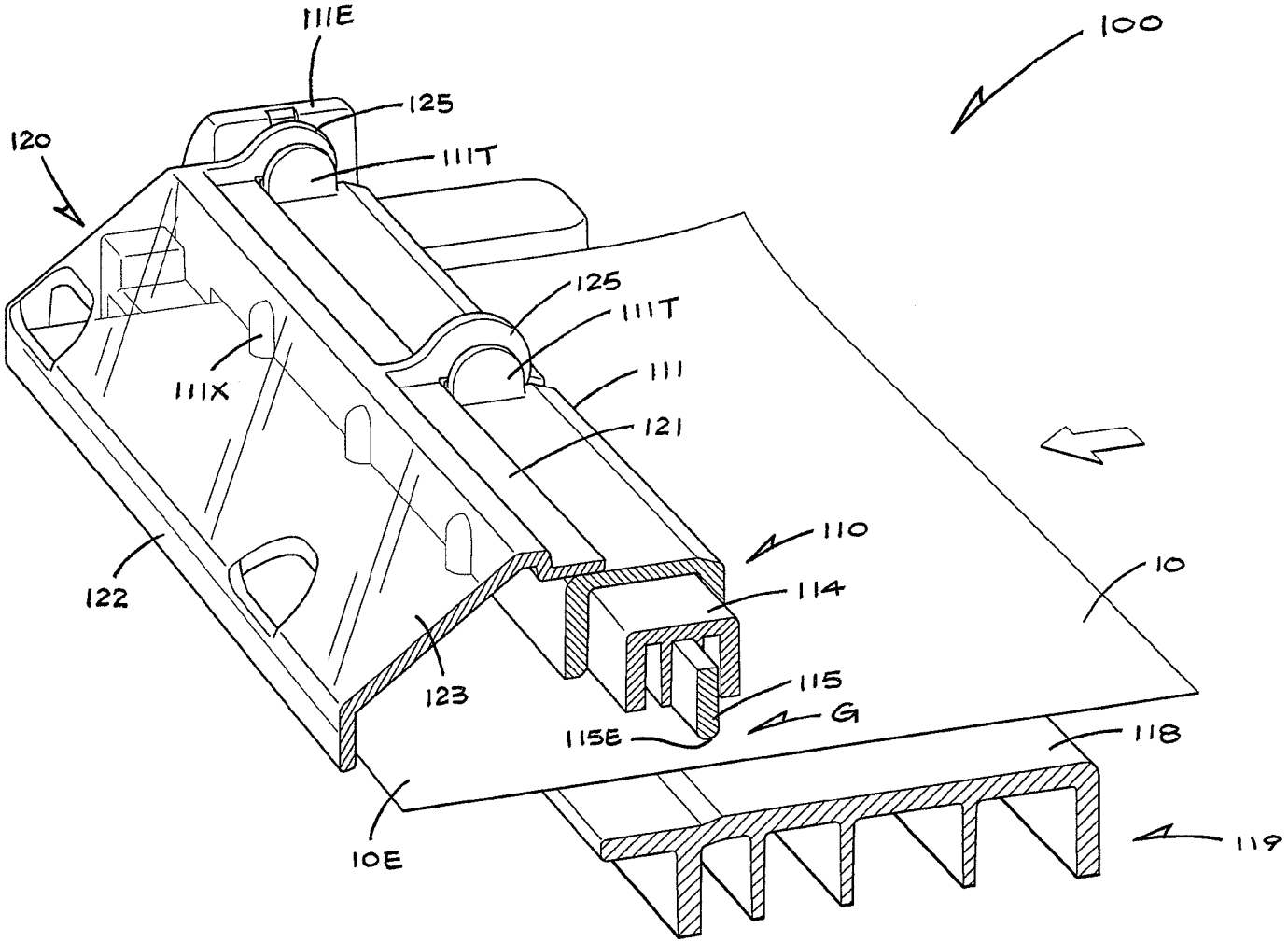
FIG. 4 is a sectioned perspective view of the sheet holder of FIG. 1, operating on a paper sheet.

Referring to the drawings, there is shown a sheet holder 100 and an edge pattern making apparatus 300 incorporating the same, embodying the invention, for making a pattern along an edge 10E of a sheet of material such as a paper sheet 10. The edge pattern making apparatus 300 includes an edge pattern maker, such as a border punch 200, designed for use with the sheet holder 100. An alternative could be an embosser that produces embossed patterns rather than perforations, and a combo is also intended.

The sheet holder 100 incorporates a holding mechanism 110 for locating and holding the paper sheet 10 and exposing an edge 11 thereof in a predetermined position for cutting by the border punch 200. An operating lever is attached to an oblong rectangular base 119 of the holding mechanism 110, which base 119 provides a horizontal platform 118 for placing the paper sheet 10. Opposite ends of the platform 118 support an inverted rectangular-section channel member 111 by its opposite ends 111E, which spans across and runs lengthwise of the platform 118, together defining a narrow gap G therebetween into which the paper sheet 10 is to be inserted from one side.

On one side of the base 119 opposite to the side from which the paper sheet 10 is to be inserted, there is a series of locating formations 111X at regular intervals along the wall of the channel member 111 for locating the border punch 200. The formations 111X are round knobs.

The holding mechanism 110 incorporates a press formed by a press bar 114 which has a rectangular comb-like cross-section facing downwards and by a rubber strip 115 located in and running along the press bar 114. The press bar 114 is received as a sliding fit inside, and almost fully within, the channel member 111 from below. A lateral edge 115E of the rubber strip 115 protrudes downwardly out from the press bar 114 into the gap G for pressing the paper sheet 10 against the platform 118 below, thereby holding the paper sheet 10 stationary on the platform 118. By virtue of its material, the rubber strip 115 ensures a firm grip upon the paper sheet 10.

The press bar 114, along with the rubber strip 115, is slidable upwards and downwards within the channel member 111, thereby closing and revealing the gap G respectively. A pair of coil springs 116 housed within respective ends 111E of the channel member 111 are compressed between the press bar 114 and the base 119 to resiliently bias the press bar 114 upwards, whereby the gap G is normally-open to permit insertion of a paper sheet or the like.

The lever 120 is an oblong member of a similar but slightly smaller footprint than the base 119, co-extending therewith. The body of the lever 120 has three portions across its width, namely inner and outer edge portions or flanges 121 and 122 inclined at about right angles 90° with each other and an oblique middle portion 123, together forming a generally trapezoidal hollow cross-section or in general a crooked cross-section.

Figure 9:
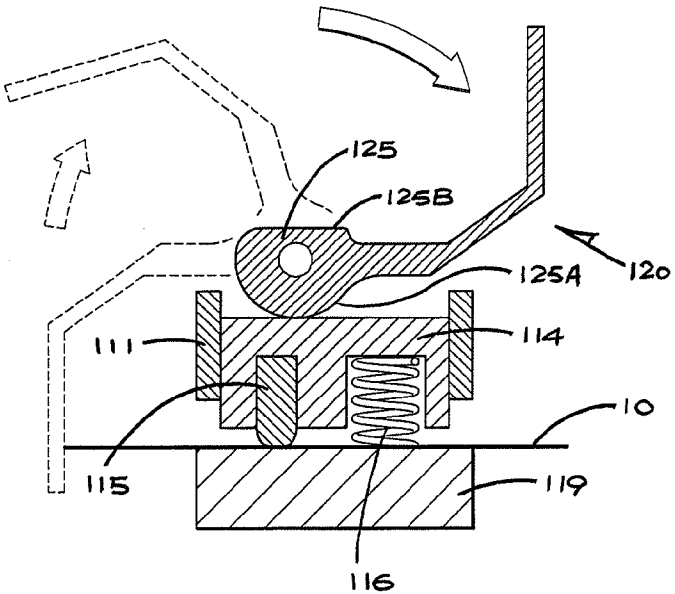
FIG. 9 is a schematic cross-sectional side view similar to FIG. 8, showing the sheet holder operating in a holding position.

Projecting at regular intervals laterally from the inner flange 121 are five identical legs 125 which are hinged to a top wall 111W of the channel member 111. This arrangement makes the lever 120 pivotable about the channel member 111 to either side thereof, between a released position crooked downwards (FIG. 8) and a holding position crooked upwards (FIG. 9).

Figure 6:
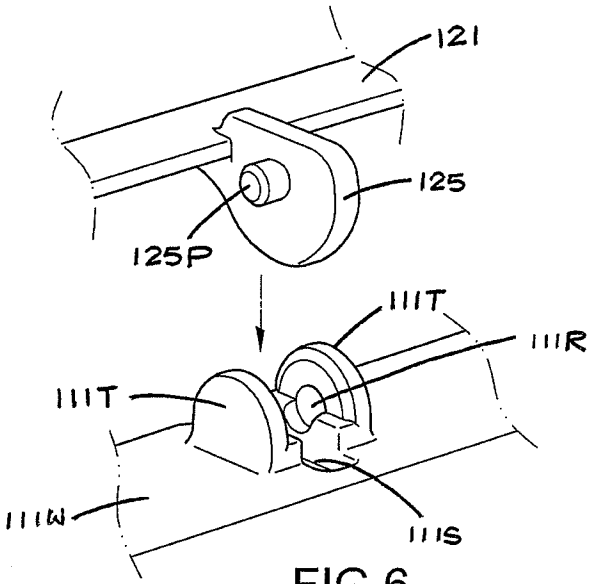
FIG. 6 is a fragmentary perspective view showing how the leg of FIG. 5 is attached.
Figure 7:
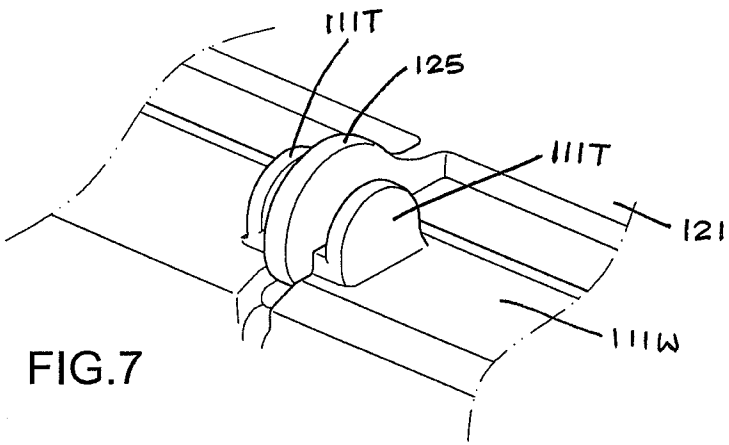
FIG. 7 is a fragmentary perspective view showing how the leg of FIG. 6 attached.
Figure 5:
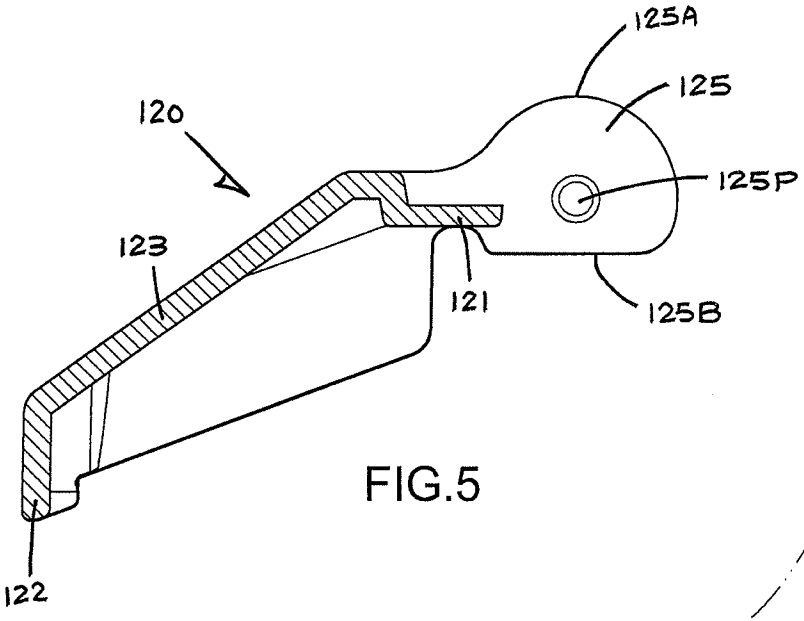
FIG. 5 is a cross-sectional side view of a leg of an operating lever of the sheet holder of FIG. 4.

Each leg 125 is flat along an imaginary vertical plane and has a pair of small hinge pins 125P aligned on opposite sides thereof. The leg 125 is sandwiched between an associated pair of tabs 111T upstanding integrally from the top wall 111W of the channel member 111, with its hinge pins 125P snap-fitted with aligned recesses 111R in the tabs 111T (FIG. 6), whereby the leg 125 is hinged to enable flipping of the lever 120.

At between the tabs 111T of each pair, there is a slot 111S through the top wall 111W of the channel member 111, which reveals the press bar 114 inside the channel member 111 and permits access thereto from above by the corresponding leg 125.

Each of the flat legs 125 has a part-circular peripheral profile which bears upon the press bar 114 through the relevant slot 111S, against the lifting bias of the springs 116. The part-circular peripheral profile is formed by a circular peripheral portion 125A and a flat peripheral portion 125B.

Figure 8:
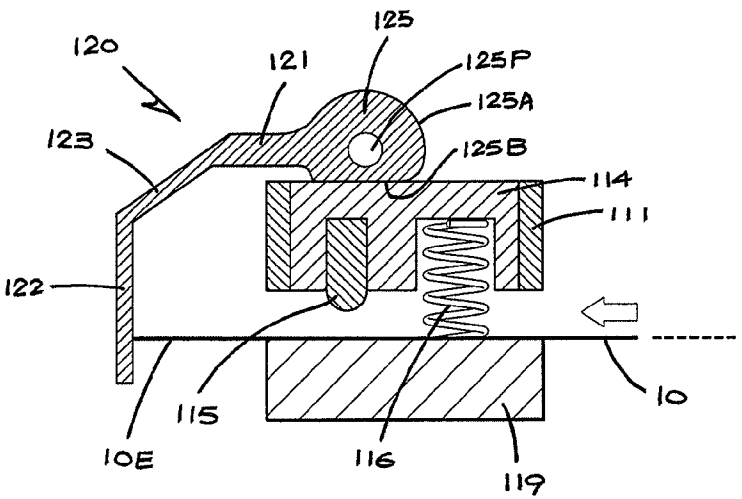
FIG. 8 is a schematic cross-sectional side view of the sheet holder of FIG. 4, showing its operation in a released position.
Figure 10:
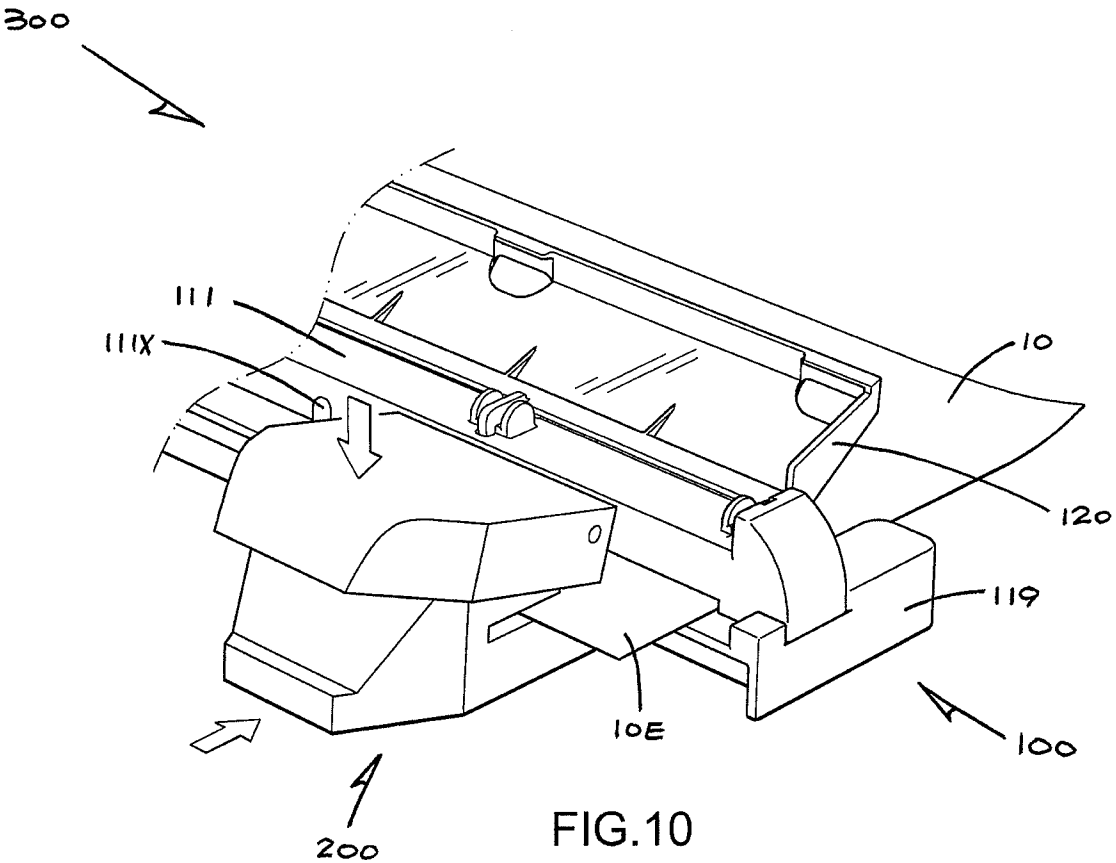
FIG. 10 is a perspective view of the sheet holder of FIG. 1 in conjunction with an edge pattern maker, together constituting an embodiment of an edge pattern making apparatus in accordance with the invention.
Figure 11:
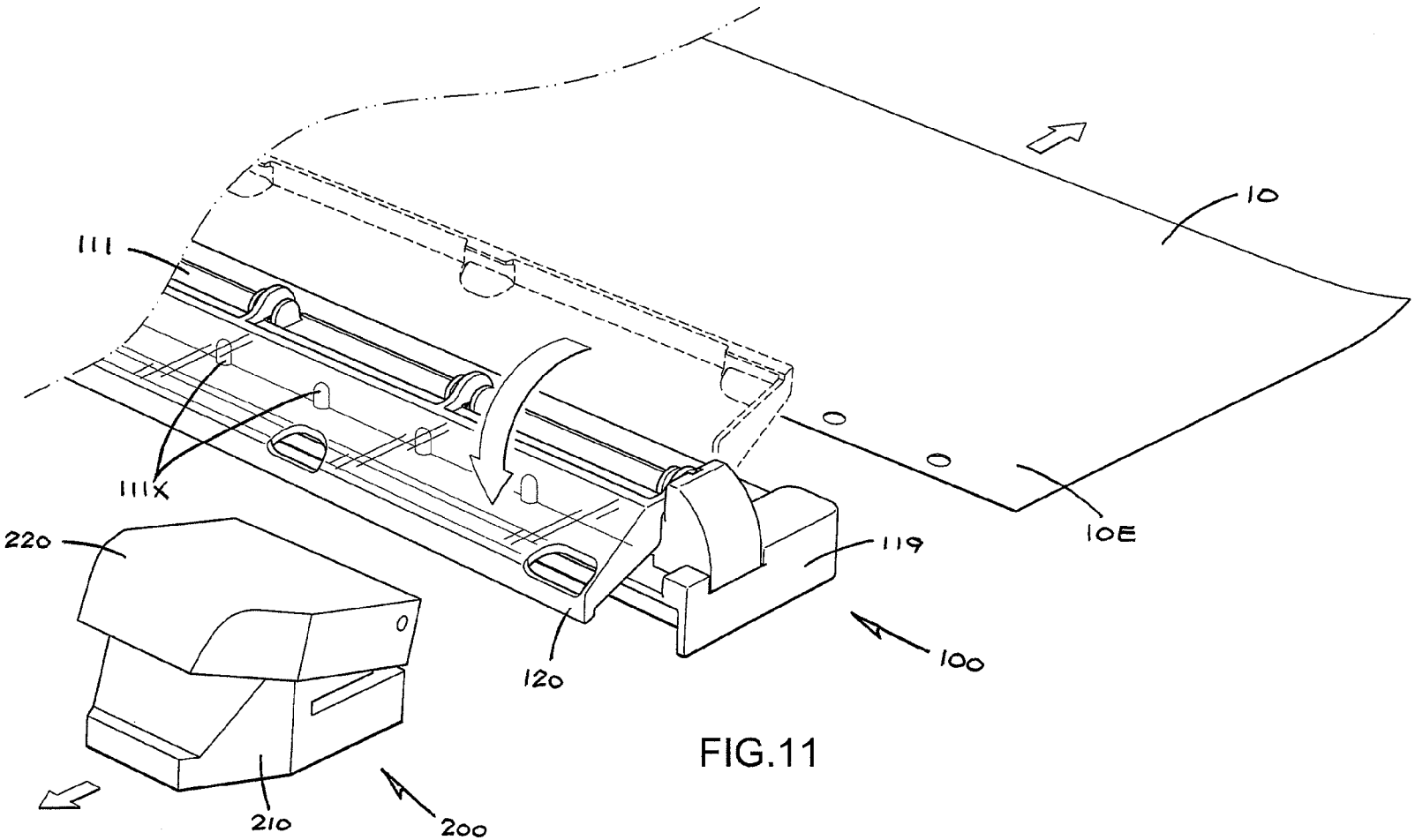
FIG. 11 is a similar perspective view showing the operation of the sheet holder and the edge pattern maker of FIG. 10.

With the flat peripheral portion 125B bearing flat against the press bar 114, the lever 120 is in the released position and stays under the action of the springs 116 acting via the press bar 114 (FIG. 8). The press bar 114 with rubber strip 115 is lifted and the gap G is opened.

In this position, the outer flange 122 hangs down to one side of the base 119, opposite to the side from which the paper sheet 10 is to be inserted into the gap G.

The outer flange 122 extends downwardly to a level lower than the bottom of the gap G (i.e. the surface of the platform 118), such that the tip of the flange 122 acts as an abutment for blocking the paper sheet 10 soon after its leading edge has come out of the gap G (FIG. 8). This is the predetermined position of the paper sheet 10 designed for operation by the border punch 200.

If the paper sheet 10 does not take up the entire width of the platform 118, it should be aligned with either upper or lower side of the platform 118 as appropriate.

Once the paper sheet 10 has reached the predetermined position as blocked by or upon abutting the tip of the outer flange 122 in the released position, the lever 120 may be flipped over up to the opposite side (FIG. 9) to lock the paper sheet 10 in the predetermined position. As the lever 120 turns upwards, its legs 125 will have their circular peripheral portions 125A roll over to and engage upon the press bar 114, thereby pressing the press bar 114 and hence the rubber strip 115 down to press upon and thus lock the paper sheet 10 in place.

As the legs' peripheral portions 125A in engagement with the press bar 114 are circular, the engagement is stable so long as the lever 120 is pivoted up. The preferred position is the end position to which the lever 120 has been turned the farthest i.e. the aforesaid holding position.

As illustrated in FIG. 9, upon the lever 120 pivoting up its outer flange 122 moves away from the edge 10E of the paper sheet 10, whereby the edge 10E is uncovered and exposed for operation by the border punch 200.

The border punch 200 has a base 210 and an operating lever 220 thereon for operating a pair of punch dies for holes (or a composite punch die assembly for cutting out a more complex pattern) in the base 210. This is a typical construction as generally known in the art.

Figure 12:
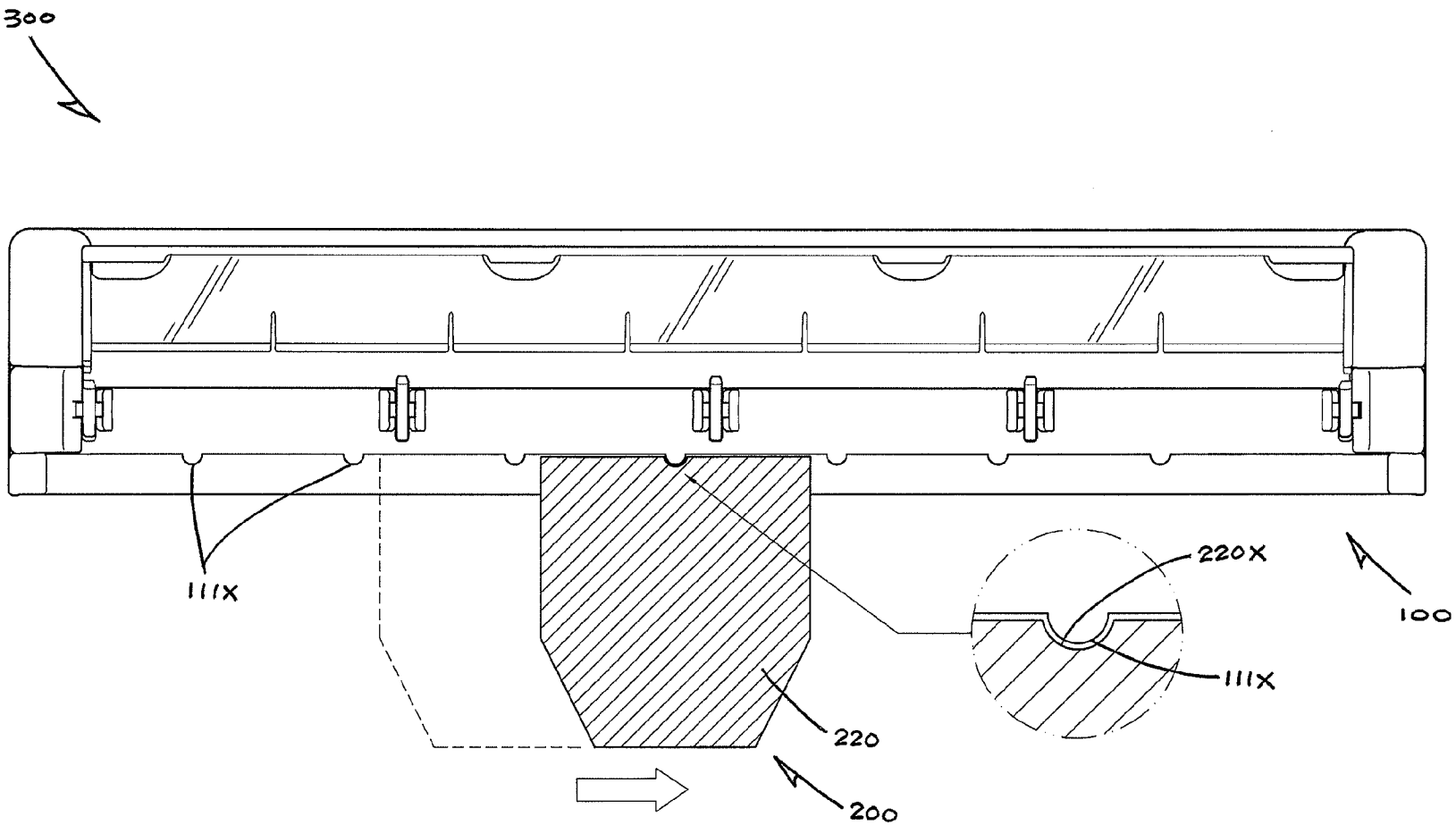
FIG. 12 is yet another, schematic top plan view showing the operation of the sheet holder and the edge pattern maker of FIG. 10.

For this particular border punch 200, on the front for example on the front of its lever 220 there is a central recess 220X. The recess 220X has a complementary cross-section as the knobs 111X for mating engagement, or alignment in general, with the knobs 111X sequentially so as to align the punch 200 with the sheet holder 100 along successive locations at regular intervals apart (FIG. 12), each for punching out a pattern (e.g. two holes in the described embodiment). As the punching operation repeats, the resulting patterns repeat along the edge 10E of the paper sheet 10 to form a series of patterns, with adjacent patterns joining seamlessly for bridging perforations if any.

The outer flange 122 for abutment by the paper sheet's edge 10E is an integral part of the lever 120. In addition to operating the holding mechanism 110, the lever 120 is also used initially to position the paper sheet 10 in the proper place before operating the holding mechanism 110 to fix the paper sheet 10. The lever 120 is convenient to use with dual functions but no increased part count.

In a different embodiment, a separate abutment may be used instead such as a bracket which is mechanically linked or otherwise associated with the lever for movement thereby such that the bracket will move away from and thus expose the edge of the sheet simultaneously as the lever moves towards the holding position. This operation is no less convenient.

In the actual products, the patterns to punch out are more complex patterns formed by perforations of various shapes and designs.

The invention has been given by way of example only, and various other modifications of and/or alterations to the described embodiment may be made by persons skilled in the art without departing from the scope of the invention as specified in the appended claims.

What is claimed is:

1. A sheet holder for holding a sheet of material and exposing an edge of the sheet of material, comprising:

a holding mechanism for holding the sheet of material and exposing the edge of the sheet of material;

an operator for operating the holding mechanism, the operator being movable between a released position for placing of the edge of the sheet of material in the holding mechanism and a holding position for operating the holding mechanism; and an abutment for abutment by the edge of the sheet of material to position the edge relative to the holding mechanism while the operator is in the released position, the abutment being associated with the operator for moving away from the edge of the sheet when the operator moves towards the holding position, thereby exposing the edge of the sheet of material, wherein the operator is supported above the holding mechanism for pivotal movement between the released position and the holding position on opposite sides of the holding mechanism, and the operator has an edge portion, which is the abutment and which, in the released position of the operator, extends downwards for abutment by the edge of the sheet of material.

2. The sheet holder as claimed in claim 1, wherein the edge portion is a flange of the operator.

3. The sheet holder as claimed in claim 1, wherein the holding mechanism comprises a press that includes a rubber grip.

4. The sheet holder as claimed in claim 1, including a wall along which the edge of the sheet of material that is exposed is to be positioned, and a series of locating formations located at a uniform interval along the wall for locating an edge pattern maker successively along the wall for repeated operations upon and along the edge that is exposed.

5. An edge pattern making apparatus for making a pattern along an edge of a sheet of material, comprising:

a sheet holder having a holding mechanism for holding the sheet of material and exposing an edge of the sheet of material, and an operator for operating the holding mechanism, the operator being movable between a released position for placing of the edge of the sheet of material in the holding mechanism and a holding position for operating the holding mechanism, the sheet holder having a wall along an exposed edge of the sheet and a series of locating formations located at a uniform interval along the wall; and an edge pattern maker for making a series of patterns along the exposed edge of the sheet of material through repeated operations, each operation making one pattern, the edge pattern maker having a part for alignment with the locating formations to locate the edge pattern maker successively along the wall of the sheet holder for the repeated operations, wherein the sheet holder includes an abutment for abutment by the edge of the sheet of material to position the edge relative to the holding mechanism while the operator is in the released position, the abutment being associated with the operator for moving away from the edge of the sheet of material when the operator moves towards the holding position, thereby exposing the edge of the sheet of material, wherein the operator is supported above the holding mechanism for pivotal movement between the released position and the holding position on opposite sides of the holding mechanism, and the operator has an edge portion, which is the abutment and which, in the released position of the operator, extends downwards for abutment by the edge of the sheet of material.

6. The edge pattern making apparatus as claimed in claim 5, wherein the edge portion is a flange of the operator.

7. The edge pattern making apparatus as claimed in claim 5, wherein the holding mechanism comprises a press that includes a rubber grip.

* * * * *